US012605034B2

(12) United States Patent
Wahl et al.

(10) Patent No.: US 12,605,034 B2
(45) Date of Patent: Apr. 21, 2026

(54) DISHWASHER

(71) Applicant: WHIRLPOOL CORPORATION, Benton Harbor, MI (US)

(72) Inventors: Evan Joseph Wahl, Saint Joseph, MI (US); Richard Lee Hammond, Mattawan, MI (US); Chandler Alexander Longley, Benton Harbor, MI (US); Emily Joy Phillips, Saint Joseph, MI (US); Elliott Vernon Stowe, Stevensvillle, MI (US); Joseph Allen Gregory, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 125 days.

(21) Appl. No.: 18/524,532

(22) Filed: Nov. 30, 2023

(65) Prior Publication Data

US 2025/0176795 A1 Jun. 5, 2025

(51) Int. Cl.
*A47L 15/42* (2006.01)
*A47L 15/44* (2006.01)

(52) U.S. Cl.
CPC ..... *A47L 15/4409* (2013.01); *A47L 15/4257* (2013.01); *A47L 15/4463* (2013.01); *A47L 15/4472* (2013.01)

(58) Field of Classification Search
None
See application file for complete search history.

(56) References Cited

U.S. PATENT DOCUMENTS

| | | | |
|---|---|---|---|
| 8,381,744 | B2 | 2/2013 | Classen et al. |
| 9,743,821 | B2 | 8/2017 | Baldwin et al. |
| 11,103,120 | B2 | 8/2021 | Fawaz et al. |
| 2011/0073141 | A1 | 3/2011 | Jerg et al. |
| 2013/0133705 | A1 | 5/2013 | Classen et al. |

FOREIGN PATENT DOCUMENTS

| | | | |
|---|---|---|---|
| CN | 115778282 | A | 3/2023 |
| DE | 102010003768 | A1 | 10/2011 |
| EP | 3721782 | A1 | 10/2020 |
| EP | 2976983 | B1 | 5/2022 |
| WO | 2022161360 | A1 | 8/2022 |

OTHER PUBLICATIONS

European Patent Office, Extended European Search Report Re: Corresponding Application No. 24214186.9-1015, dated Apr. 7, 2025, 11 pages, Munich, Germany.

*Primary Examiner* — Levon J Shahinian
(74) *Attorney, Agent, or Firm* — McGarry Bair PC

(57) ABSTRACT

A household appliance for treating articles according to an automatic cycle of operation, the household appliance comprising: a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface. The dispenser assembly can include a cartridge receptacle, a cover, and a linkage.

20 Claims, 10 Drawing Sheets

DISHWASHER

BACKGROUND

Contemporary appliances for use in a typical household include a cabinet with an interior tub, drum, or the like at least partially defining a treating chamber into which articles can be placed for treatment according to an automatic cycle of operation. Such articles can include kitchenware, glassware, or clothing items in some examples. A dispensing system can be provided for supplying treating chemistry to the treating chamber. A user interface can be provided for selecting, modifying, or otherwise controlling a cycle of operation of the household appliance.

BRIEF DESCRIPTION

In one aspect, the disclosure relates to a household appliance for treating articles according to an automatic cycle of operation, the household appliance comprising a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface. The dispenser assembly can include a cartridge receptacle defining a cartridge seat, a cover, and a linkage coupling the cartridge receptacle and the cover such that the cartridge receptacle and the cover are movable relative to each other.

DETAILED DESCRIPTION

The disclosure generally relates to a dispensing assembly for a household appliance. In typical household appliances, such as dishwashers, the treating chamber may include a dispenser chamber with a connected flip-top or rotatable lid, wherein a user supplies treating chemistry to the chamber and closes the lid prior to a cycle of operation.

Aspects of the dispensing assembly disclosed herein include a cartridge receptacle defining a cartridge seat, a cover, and a linkage coupling the cartridge receptacle and the cover such that the cartridge receptacle and the cover are movable relative to each other.

Figure 1:
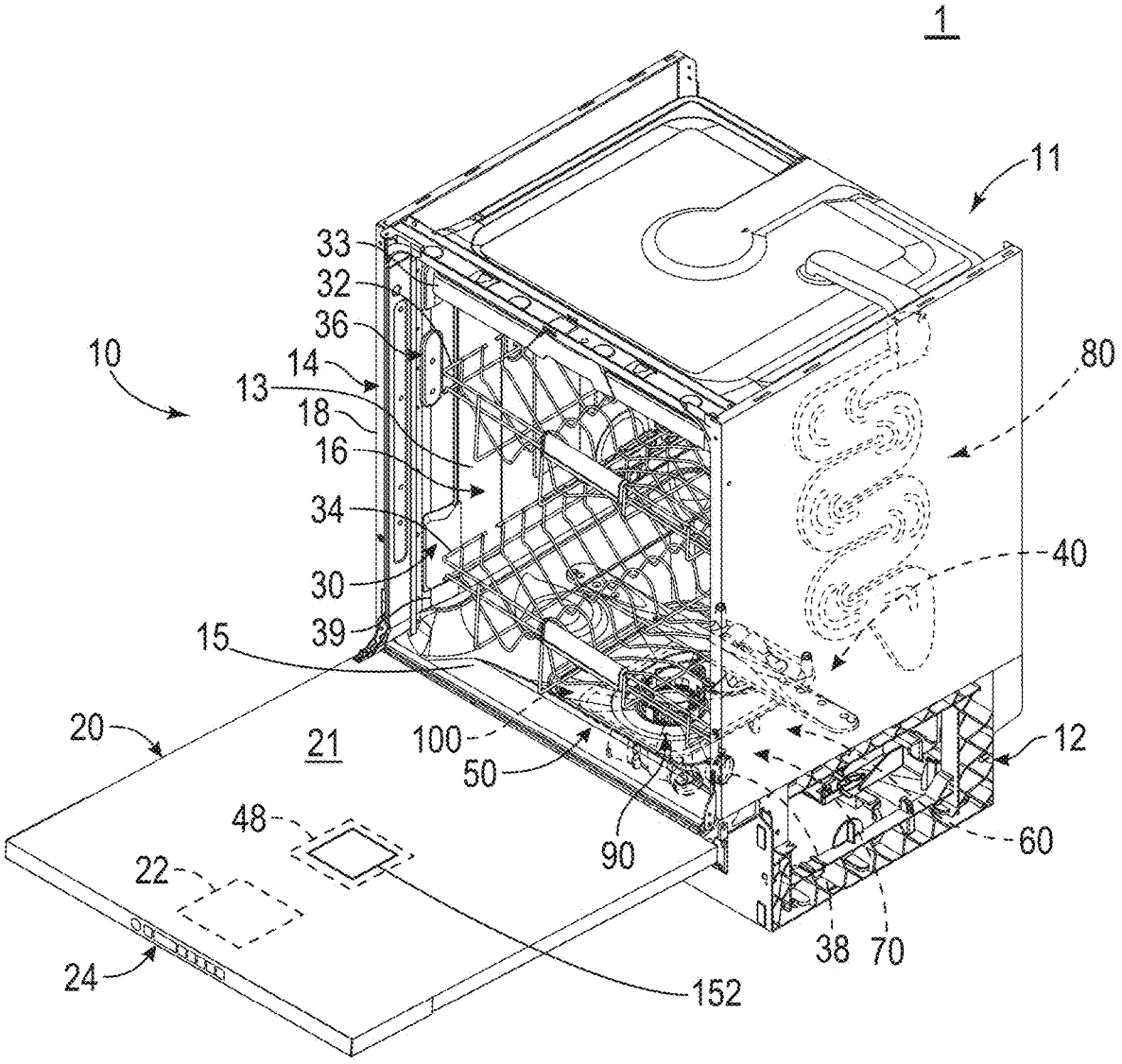
FIG. 1 is a right-side perspective view of an exemplary household appliance in the form of an automatic dishwasher having multiple systems for implementing an automatic cycle of operation.

FIG. 1 illustrates an exemplary household appliance 1 capable of implementing an automatic cycle of operation for treating articles. The household appliance 1 can include any suitable appliance such as a dishwasher, a steam treatment appliance, a clothes washer, a clothes dryer, a combination washer/dryer, or the like, in non-limiting examples.

In the illustrated example, the household appliance 1 is in the form of a dishwasher 10 for treating dishes. As used in this description, the term "dish(es)" or "dish item(s)" is intended to be generic to any item, single or plural, that can be treated in the dishwasher 10, including, without limitation, dishes, plates, pots, bowls, pans, glassware, or silverware. As illustrated, the dishwasher 10 is a built-in dishwasher implementation, which is designed for mounting under a countertop. However, this description is applicable to other dishwasher implementations such as a stand-alone, drawer-type, or a sink-type, for example.

The dishwasher 10 has a variety of systems, some of which are controllable, to implement the automatic cycle of operation. A chassis 11 is provided to support the variety of systems for implementing the automatic cycle of operation. The chassis 11 includes an interior surface 13 that at least partially defines a treating chamber 16. The treating chamber 16 includes an open face for receiving the dishes 18. As illustrated, for a built-in implementation, the chassis 11 includes a frame in the form of a base 12 and an open-faced tub 14 supported on the base 12. The open-faced tub 14 includes a tub surface 15 at least partially defining the treating chamber 16. The chassis 11 includes a closure in the form of a door assembly 20. The door assembly 20 is pivotally mounted to the base 12 for movement between opened and closed positions to selectively open and close the open face of the treating chamber 16, such as for loading and unloading of dishes or other items. The door assembly 20 includes an inner door surface 21 at least partially defining the treating chamber 16. In this manner, the interior surface 13 can include at least one of the tub surface 15 or the inner door surface 21.

The chassis 11, as in the case of the built-in dishwasher implementation, can be formed by portions of the dishwasher 10, like the tub 14 and the door assembly 20, in addition to a dedicated frame structure, like the base 12, with them all collectively forming a unibody frame to which the variety of systems are supported. In other implementations, such as a drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis 11, while essentially limitless, can include a dish holding system 30, a spray system 40, a recirculation system 50, a drain system 60, a water supply system 70, a drying system 80, a heating system 90, and a filter system 100. These systems are used to implement one or more treating cycles of operation for the dishes, for which there are many, and one of which includes a traditional automatic wash cycle.

A basic automatic wash cycle of operation has a wash phase, where a detergent/water mixture is recirculated and then drained, which is then followed by a rinse phase where water alone or with a rinse agent is recirculated and then drained. An optional drying phase can follow the rinse phase. The automatic wash cycle can have multiple wash phases and multiple rinse phases. The multiple wash phases can include a pre-wash phase where water, with or without detergent, is sprayed or recirculated on the dishes, and can include a dwell or soaking phase. There can be more than one pre-wash phase. A wash phase, where water with detergent is recirculated on the dishes, follows the pre-wash phase(s). There can be more than one wash phase; the number of which can be sensor controlled based on the amount of sensed soils in the wash liquid. One or more rinse phases can follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry, or any combination thereof.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis 11. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of an upper dish rack 32 and a lower dish rack 34, referred to as "racks", which are located within the treating chamber 16. The upper dish rack 32 and the lower dish rack 34 are typically mounted for slidable movement in and out of the treating chamber 16 through the open face for ease of loading and unloading. Drawer guides, which can include slides or rails 36, can be used to slidably mount the upper dish rack 32 to the tub 14. The lower dish rack 34 can have wheels or rollers 38 that roll along rails 39 formed in sidewalls of the tub 14 and onto the door assembly 20 when the door assembly 20 is in the opened position.

Dedicated dish holders can also be provided. One such dedicated dish holder is a third-level rack 33 located above the upper dish rack 32. Like the upper dish rack 32, the third-level rack is slidably mounted to the tub 14 with rails 36. The third-level rack 33 can be used to hold utensils, such as tableware, spoons, knives, spatulas, etc., in an on-the-side or flat orientation. However, the third-level rack 33 is not limited to holding utensils. If an item can fit in the third-level rack 33, it can be washed in the third-level rack 33. The third-level rack 33 generally has a much shorter height or lower profile than the upper and lower dish racks 32, 34. The height of the third-level rack 33 can be short enough that a typical glass cannot stand vertically in the third-level rack 33 within the treating chamber 16.

Another dedicated dish holder can be a silverware basket (not shown), which is typically carried by one of the upper or lower dish racks 32, 34 or mounted to the door assembly 20. Such a silverware basket can hold utensils and the like in an upright orientation as compared to the on-the-side or flat orientation of the third-level rack 33.

A dispenser assembly 48 is provided to dispense treating chemistry (e.g., detergent, anti-spotting agent, etc.) into the treating chamber 16. The dispenser assembly 48 can dispense one or more types of treating chemistries. The dispenser assembly 48 can be a single-use dispenser or a bulk dispenser, or a combination of both.

The dispenser assembly 48 is operably coupled to the interior surface 13 of the treating chamber 16. In the illustrated example, the dispenser assembly 48 is coupled to the inner door surface 21 though this need not be the case. The dispenser assembly 48 can also be coupled to the tub surface 15 in some implementations. It is also contemplated that multiple dispenser assemblies 48 can be provided, including on the inner door surface 21, the tub surface 15, or a combination thereof.

Figure 2:
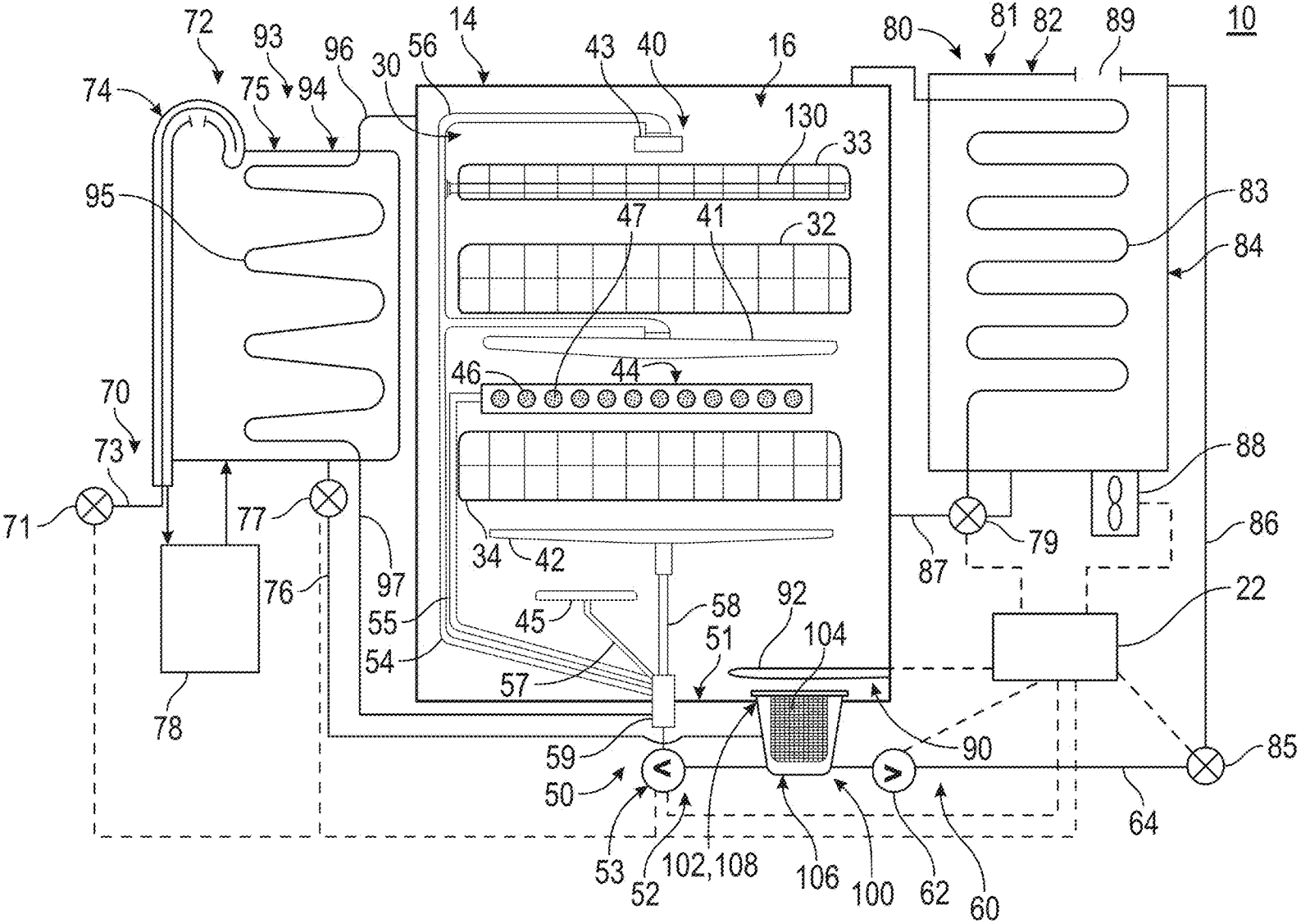
FIG. 2 is a schematic front view of the household appliance of FIG. 1 illustrating some exemplary plumbing and electrical connections between at least some of the multiple systems.

Turning to FIG. 2, the spray system 40 is provided for spraying liquid in the treating chamber 16 and can have a set of spray assemblies or sprayers 41-45, 130, some of which can be dedicated to a particular one of the dish holders, to particular area of a dish holder, to a particular type of cleaning, or to a particular level of cleaning, etc. The set of sprayers 41-45, 130 can be fixed or movable, such as rotating, relative to the treating chamber 16 or dish holder. Six exemplary sprayers are illustrated in the set of sprayers 41-45, 130 and include an upper spray arm 41, a lower spray arm 42, a third level sprayer 43, a deep-clean sprayer 44, a spot sprayer 45, and a tube sprayer 130. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third-level rack 33. The third level sprayer 43 is illustrated as being fixed, but could move, such as by rotating. In addition to the third level sprayer 43 or in place of the third level sprayer 43, the tube sprayer 130 can be located at least in part below a portion of the third-level rack 33. The tube sprayer 130 is illustrated as a fixed tube, carried by the third-level rack 33, but could be movable, such as by rotating about a longitudinal axis.

The deep-clean sprayer 44 is a manifold extending along a rear wall of the tub 14 and has multiple nozzles 46, with multiple apertures 47, generating an intensified and/or higher-pressure spray than the upper spray arm 41, the lower spray arm 42, or the third level sprayer 43. The nozzles 46 can be fixed or move, such as by rotating. The spray emitted by the deep-clean sprayer 44 defines a deep clean zone, which, as illustrated, would be disposed along a rear side of the lower dish rack 34. Thus, dishes for deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below, or beside any of the dish holders where deep-cleaning is desired.

The spot sprayer 45, like the deep-clean sprayer, can emit an intensified and/or higher-pressure spray, especially to a discrete location within one of the dish holders. While the spot sprayer 45 is shown below the lower dish rack 34, it could be adjacent any part of any dish holder or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as by rotating.

These upper spray arm 41, the lower spray arm 42, the third level sprayer 43, the deep-clean sprayer 44, the spot sprayer 45, and the tube sprayer 130 are illustrative examples of suitable sprayers and are not meant to be limiting as to the type of suitable sprayers in the set of sprayers 41-45, 130.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recessed portion of a bottom wall of the tub 14. The pump assembly 52 can include one or more pumps such as a recirculation pump 53. The sump 51 can also be a separate module that is affixed to the bottom wall and include the pump assembly 52.

Multiple liquid supply conduits 54, 55, 56, 57, 58 fluidly couple the set of sprayers 41-45, 130 to the recirculation pump 53. A recirculation valve 59 can selectively fluidly couple each of the conduits 54-58 to the recirculation pump 53. While each sprayer 41-45, 130 is illustrated as having a corresponding dedicated supply conduit 54-58 one or more subsets, comprising multiple sprayers from the total group of sprayers 41-45, 130 can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54-58 can be directly coupled to the recirculation pump 53, while one or more of the other conduits 54-58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53, 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 can be more robust than the recirculation pump 53 as the drain pump 62 tends to have to remove solids and soils from the sump 51, unlike the recirculation pump 53, which may recirculate liquid which has solids and soils filtered away to some extent.

The water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

The drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, the recirculation system 50, the drain system 60, or the water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way, a fluid circuit is formed by the drain pump 62, the drain line 64, the valve 85, the supply conduit 86, the cooling tank 84, the return valve 79, and the return conduit 87 through which liquid can be supplied from the treating chamber 16 to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of or in addition to cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air can be used when the cooling tank 84 is not filled with liquid. Advantageously, the use of cooling air or cooling water, or combination of both, can be selected according to the site-specific environmental conditions. If ambient air is cooler than the cold water temperature, then the ambient air can be used. If the cold water is cooler than the ambient air, then the cold water can be used. Energy efficiency and/or cost-effectiveness can also be taken into account when selecting one or both of cooling air or cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

The heating system 90 is provided for heating water used in the cycle of operation. The heating system 90 includes a heater 92, such as an immersion heater, located in the treating chamber 16 at a location where it will be immersed in the water supplied to the treating chamber 16. The heater 92 need not be an immersion heater. The heater 92 can also include an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As various wash phases use liquid that is heated by the heater 92, this heated liquid can then be recirculated through the heating circuit 93 to transfer the heat to the charge of water in the supply tank 75, which can be used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
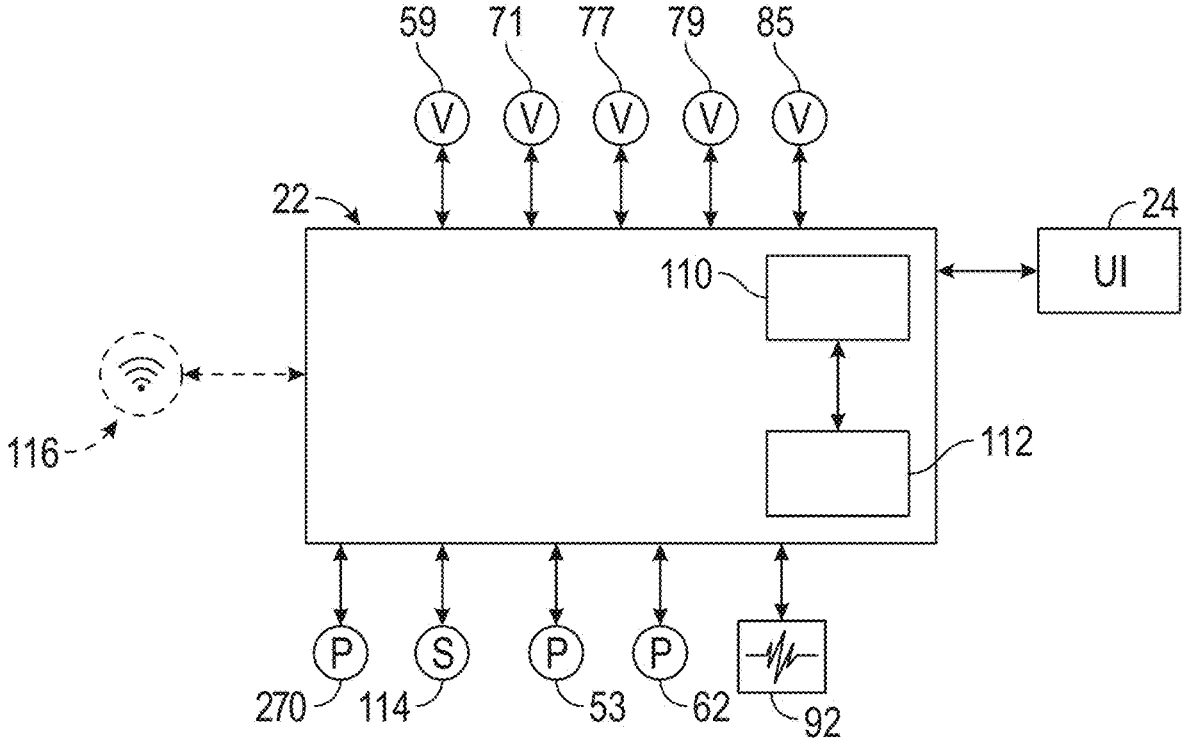
FIG. 3 is a schematic view of a controller of the household appliance of FIG. 1.

As illustrated schematically in FIG. 3, the controller 22 can be coupled with the heater 92 for heating the wash liquid during a cycle of operation, the drain pump 62 for draining liquid from the treating chamber 16 (FIG. 2), and the recirculation pump 53 for recirculating the wash liquid during the cycle of operation. The controller 22 can be provided with a memory 110 and a processor, such as a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, but are not limited to, an ambient air temperature sensor, a treating chamber temperature sensor, a water supply temperature sensor, a door open/close sensor, and a turbidity sensor. A turbidity sensor may determine the soil load associated with a selected grouping of dishes, such as the dishes associated with a particular area of the treating chamber 16. The controller 22 can also communicate with the recirculation valve 59, the household water valve 71, the controllable valve 77, the return valve 79, and/or the valve 85. Optionally, the controller 22 can include or communicate with a wireless communication device 116.

While the non-limiting embodiment shown in FIGS. 1-3 is described and illustrated with various features and components, other embodiments can include subsets of those features and components. For example, some embodiments may not include tanks 75, 84, a water softener 78, and/or a heat exchanger 94, among other features and components.

Figure 4:
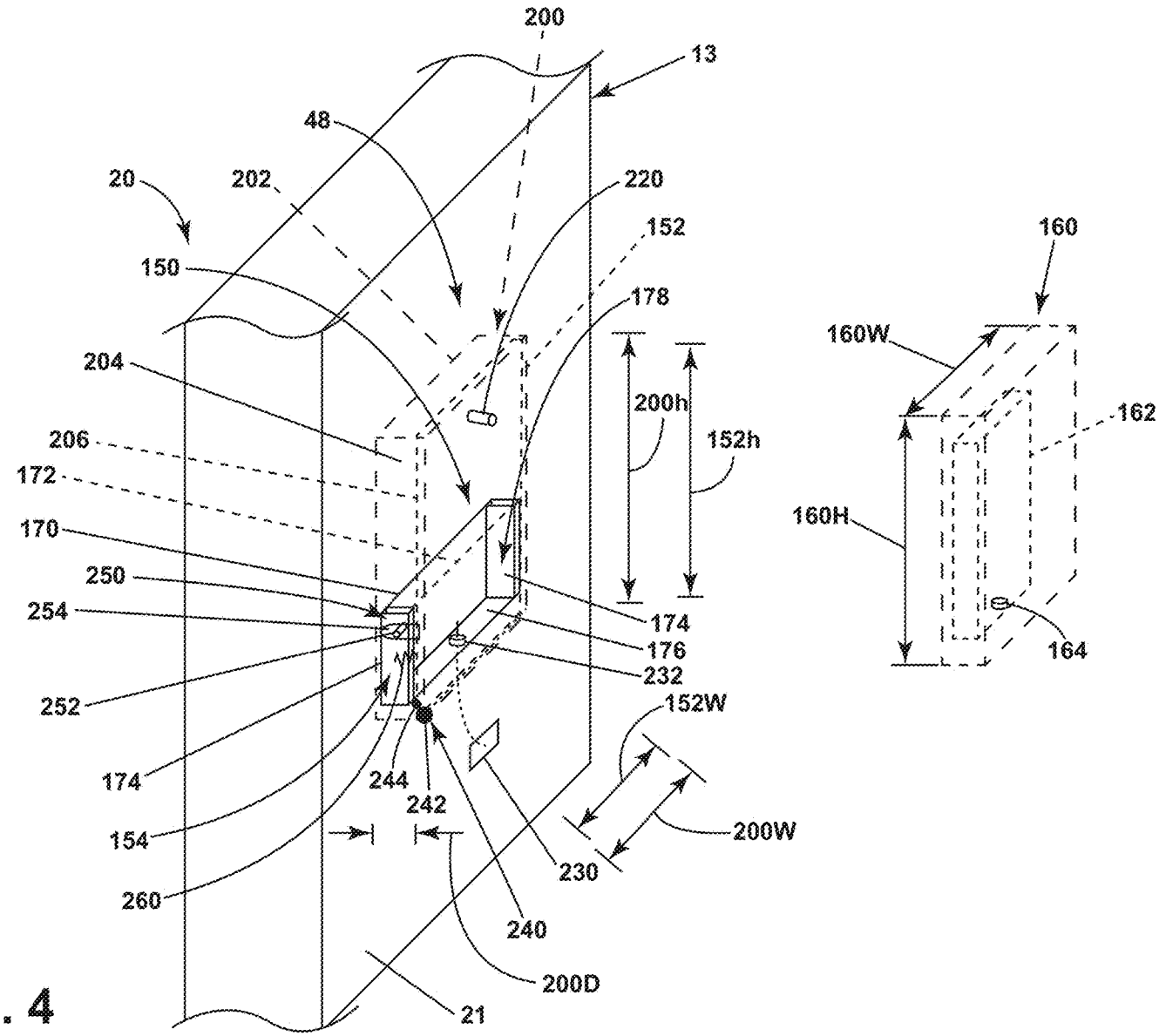
FIG. 4 is a schematic perspective view of a dispenser assembly in the household appliance of FIG. 1 in accordance with various aspects described herein.

Referring now to FIG. 4, a portion of the door assembly 20 of the dishwasher 10 is shown with the dispenser assembly 48 in accordance with various aspects described herein. While the dispenser assembly 48 is shown located in the door assembly 20, it can be located relative to any surface forming part of the treating chamber 16 (FIG. 1). The dispenser assembly 48 includes a cartridge receptacle 150, a cover 152, a linkage 154, and/or a cartridge 160. The linkage 154 can couple the cartridge receptacle 150 and the cover 152 such that that cartridge receptacle 150 and the cover 152 are movable relative to each other. The cartridge 160 is shown outside of the door assembly 20 before insertion into the cartridge receptacle 150.

The cartridge 160 can include at least one treating chemistry reservoir 162 for containing any suitable amount of treating chemistry, including a single dose or charge, or multiple doses or charges. The cartridge 160 can also include a fluid outlet port 164 fluidly coupled to the treating chemistry reservoir 162. The fluid outlet port 164 can extend or project from the cartridge 160 or can also be positioned along or within the cartridge 160 in some implementations. The cartridge 160 additionally defines a cartridge width 160W and a cartridge height 160H as shown. The cartridge width 160W can be the same as, smaller than, or larger than the cartridge height 160H.

The cartridge receptacle 150 can include a rear wall 170, a front wall 172 spaced from the rear wall 170, two side walls 174, and base wall 176. One or more of the rear wall 170, the front wall 172, the two side walls 174, or the base wall 176 can at least partially define a cartridge seat 178 into which the cartridge 160 can be at least partially inserted. The front wall 172 is shown as transparent in FIG. 4 for illustrative purposes.

The interior surface 13, such as the inner door surface 21, defines a dispenser recess 200. The dispenser recess 200 includes a rear wall 202 and a peripheral wall 204. The peripheral wall 204 extends from the rear wall 202 and defines an open face 206 opposite the rear wall 202. The dispenser recess 200 at least partially receives the cartridge receptacle 150, the cover 152, and/or the cartridge 160, such as depending on the position of the dispenser assembly 48. The dispenser recess 200 defines a width 200W, a height 200H, and a depth 200D.

Optionally, the cover 152 can include a handle 220, including a projecting handle, a pocket handle, a surface grip, a tab, a flange, or the like for movement of the cover 152. Additionally or alternatively, the cover 152 can be selectively engaged with the interior surface 13 via a push-push latch, a push button, a slide to release mechanism, an electronic latch release, or a combine thereof. The cover 152 additionally defines a cover width 152W and a cover height 152H. The cover width and height 152W, 152H can correspond to the recess width and height 200W, 200H, respectively. For example, in some configurations, the cover width and height 152W, 152H can be at least slightly smaller than the recess width and height 200W, 200H such that the cover 152 can be disposed at least partially in the dispenser recess 200. In such configurations, the cover 152 can be disposed in the dispenser recess 200 such that the cover 152 is flush with the inner door surface 21. In other configurations, the cover width and height 152W, 152H can be at least slightly larger than the recess width and height 200W, 200H such that the cover 152 is disposed at least partially outside of the dispenser recess 200 in all positions of the dispenser assembly 48. In some configurations, the height of the cartridge receptacle 150, such as the walls 170-174, can be shorter than the height 152H of the cover 152. For example and without limitation, the walls 170-174 can be 50% or less than the height 152H of the cover 152. In some configurations, the interior surface 13 may not include the dispenser recess 200. For example, the dispenser assembly 48 can include a housing attached to the interior surface 13 and defining the dispenser recess 200.

The dispenser assembly 48 can include a dispenser outlet 230 and a fluid connection port 232. In some configurations, the dispenser assembly 48 can include a plurality of dispenser outlets 230, such as for each treating chemistry. The dispenser outlet 230 can be provided on the interior surface 13, such as the inner door surface 21, but can be provided at other locations. The fluid connection port 232 can be disposed at the peripheral wall 204 of the dispenser recess 200 and/or at least partially in the cartridge receptacle 150 and/or the cartridge seat 178, such as in the base wall 176. Additionally or alternatively, one or more fluid connection ports 232 can be disposed on the inner door surface 21 spaced from the dispenser recess 200, or on a surface having no such recess. The fluid connection port 232 is fluidly coupled to the dispenser outlet 230, such as by a fluid conduit, tubing, or the like. The fluid connection port 232 is configured to couple with the fluid outlet port 164 of the cartridge 160. For instance, either or both of the fluid connection port 232 or the fluid outlet port 164 can include a piercing end, a cannula, a membrane, a press-fit connector, a valve, or the like.

The dishwasher 10 (e.g., the dispenser assembly 48) includes a pivot coupling 240 that pivotably couples the cartridge receptacle 150 and the cover 152 with the interior surface 13. In some configurations, the pivot coupling 240 is disposed at a front edge (e.g., a lower front edge) of the dispenser recess 200, such as of the peripheral wall 204. The pivot coupling 240 can, for example, include a hinge. The pivot coupling 240 is coupled to the cartridge receptacle 150 and the cover 152 such that the cartridge receptacle 150 and the cover 152 are movable (e.g., pivotable) relative to each other and at least partially into and out of the dispenser recess 200. For example, the pivot coupling 140 can define at least one pivot axis about which the cartridge receptacle 150 and the cover 152 are relatively pivotable. The at least one pivot axis can include a first pivot axis 242 about which the cover 152 is pivotable and a second pivot axis 244 about which the cartridge receptacle 150 is pivotable, with the first and second pivot axes 242, 244 being different from each other (see, e.g., FIG. 4). Alternatively, the at least one pivot axis can include the first pivot axis 242, and both of the cartridge receptacle 150 and the cover 152 can be pivotable (e.g., relative to each other) about the first pivot axis 242 (see, e.g., FIG. 5).

The linkage 154 of the dispenser assembly 48 can include one or more of a variety of configurations that movably couple the cartridge receptacle 150 and the cover 152. The linkage 154 can include a retainer 250 and a post 252. The retainer 250 can define a slot 254 in which the post 252 is partially disposed. One of the cartridge receptacle 150 or the cover 152 includes the retainer 250 and the other of the cartridge receptacle 150 or the cover 152 includes the post 252. The post 252 is disposed in the slot 254 such that the cartridge receptacle 150 and the cover 152 can move relative to each other, at least to some extent. For example, with relative movement between the cartridge receptacle 150 and the cover 152, the post 252 can move along the slot 254 (or vice versa) until the post 252 reaches an end of the slot 254. When the post 252 reaches the end of the slot 254, the cartridge receptacle 150 and the cover 152 may move together, at least to some extent. The slot 254 can be curved according a distance of the retainer 250 and/or the post 252 from the pivot coupling 240. In configurations with the cover 152 including the retainer 250, the retainer 250, the retainer 250 can extend from the inner surface of the cover 152 toward the cartridge receptacle 150 and/or the rear wall 202 of the dispenser recess 200. The retainer 250 can extend into, next to, and/or beyond the cartridge receptacle 150, at least in some configurations.

The linkage 154 can, additionally or alternatively, include a spring 260. The spring 260 can be attached to the cartridge receptacle 150 and the cover 152 and may bias the cartridge receptacle 150 away from the cover 152, such as toward the dispenser recess 200. The spring 260 can include one or more of a variety of configurations. For example, the spring 260 can include one or more of a coil spring, a leaf spring, a blade spring, or a combination thereof. In some implementations, the spring 260 can be incorporated into the pivot coupling 240, such as by a spring hinge or the like.

Figure 5:
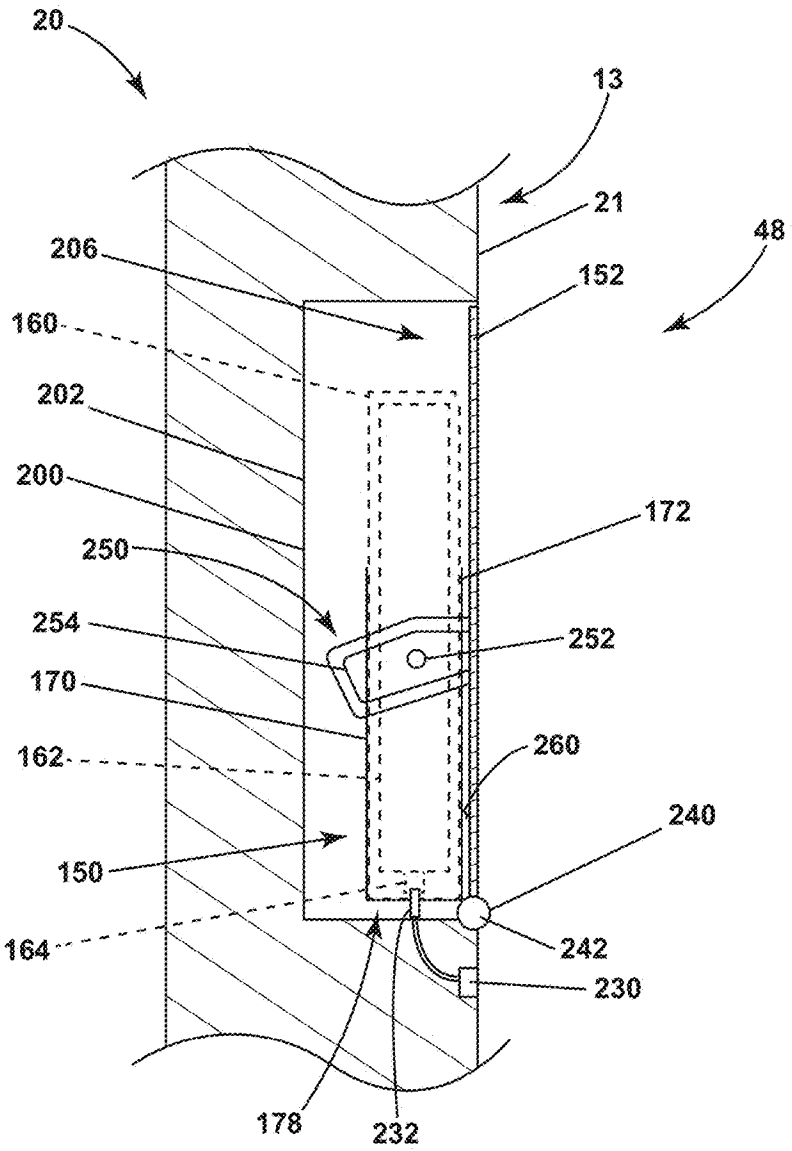
FIG. 5 is a cross-sectional view of the dispenser assembly of FIG. 4 with the dispenser assembly in a dispensing position.
Figure 6:
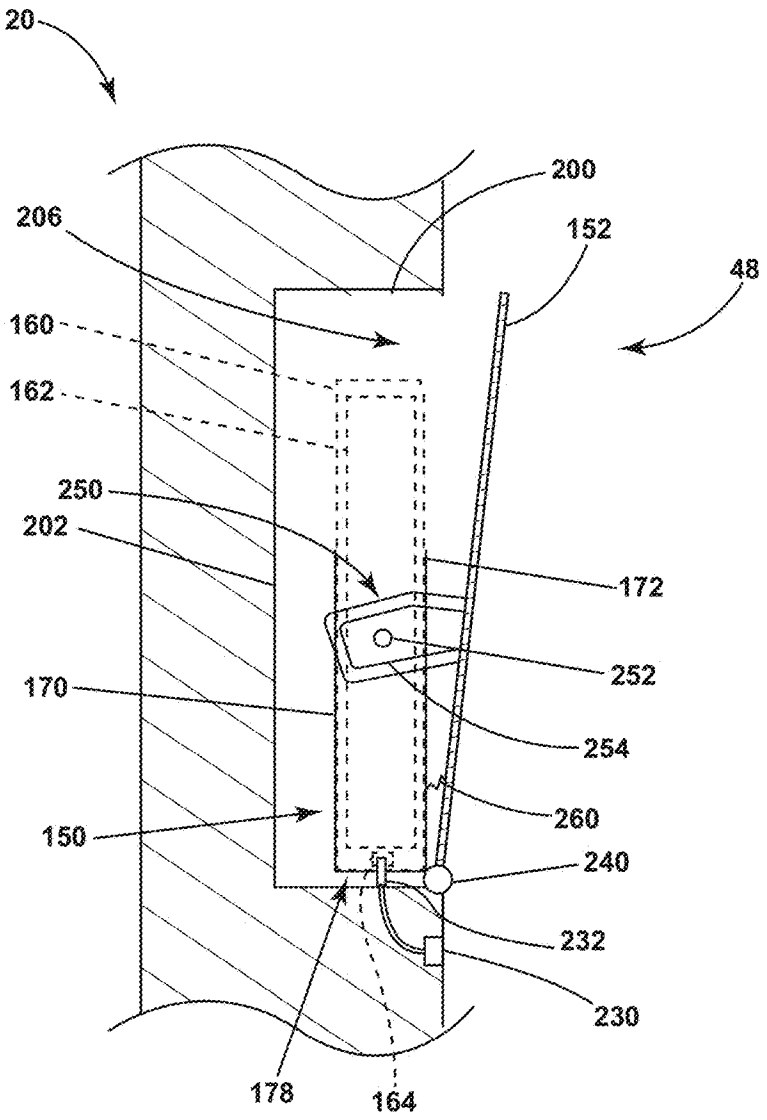
FIG. 6 is a cross-sectional view of the dispenser assembly of FIG. 4, similar to FIG. 5, and illustrating a cover of the dispenser assembly in an intermediate position.
Figure 7:
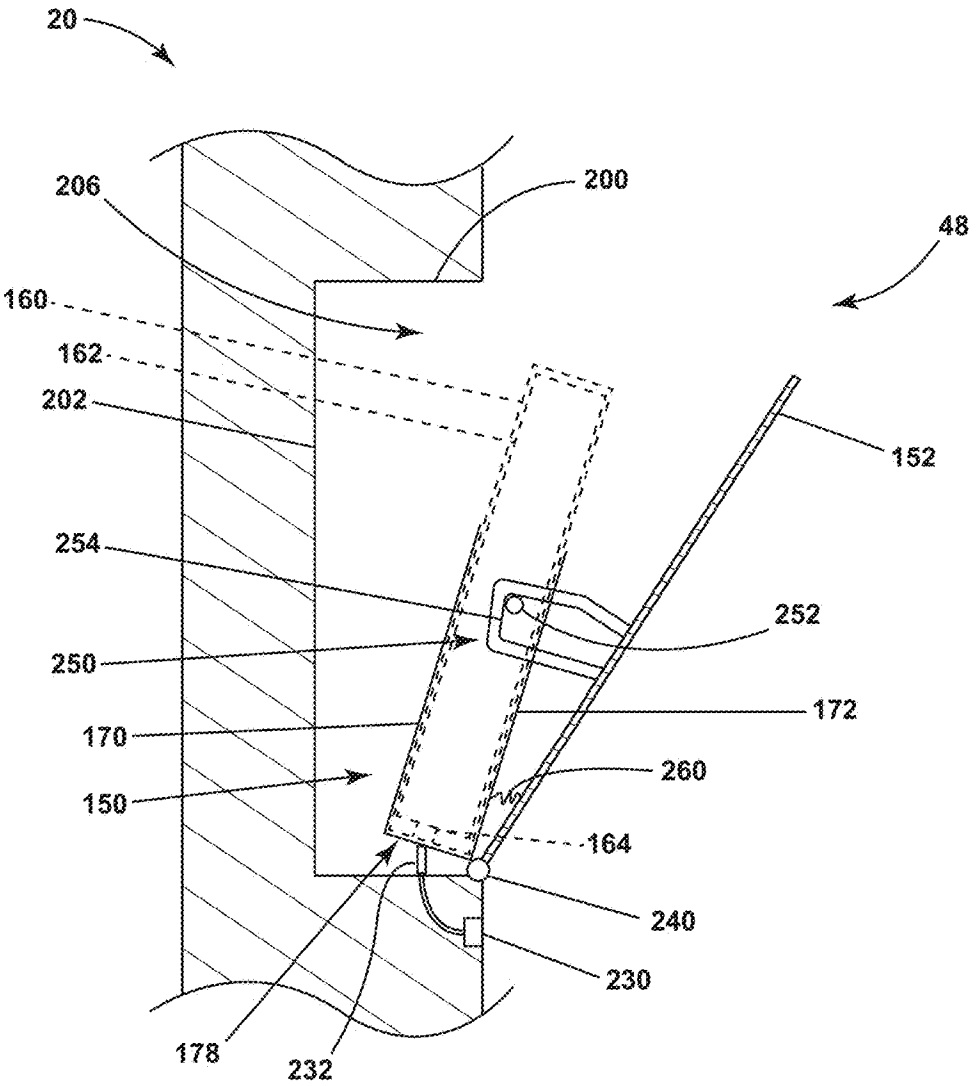
FIG. 7 is a cross-sectional view of the dispenser assembly of FIG. 4, similar to FIGS. 5-6, and illustrating the dispenser assembly in an access position.

FIGS. 5-7 illustrate various exemplary positions of the dispenser assembly 48, including a dispensing position (FIG. 5), an intermediate position (FIG. 6), and an access position (FIG. 7). The cover 152 can be movable between a retracted position (FIG. 5), a partially extended position (FIG. 6), and an extended position (FIG. 7). The pivot coupling 240 facilitates movement (e.g., pivoting) of the dispenser assembly 48 between the dispensing, intermediate, and access positions, which can include facilitating movement of the cover 152 between the retracted, partially extended, and extended positions. In addition, the cartridge 160 is insertable into the cartridge receptacle 150 and the cartridge seat 178 to define a seated position, as shown in FIGS. 5 and 6.

Referring to FIG. 5, a cross-sectional view illustrates the dispensing position of dispenser assembly 48 with the cover 152 in the retracted position, the cartridge 160 in the seated position in the cartridge seat 178 of the cartridge receptacle 150, and the cartridge receptacle 150 disposed in the dispenser recess 200. The cartridge 160, the rear wall 170, the front wall 172, and the cover 152 are parallel to the rear wall 202 of the dispenser recess 200 but can be disposed at other angles. The cover 152 covers the open face 206, closing the dispenser recess 200. In some configurations, the cover 152 in the retracted position is fluidly sealed with the adjacent portions of the interior surface 13, such as to fluidly seal the dispenser recess 200, other than fluid connection port 232. In the illustrated example, the cover 152 is aligned, flush, and/or coplanar with the interior surface 13 (e.g., the inner door surface 21), but the cover 152 can be disposed in other manners. For example, in some implementations, the cover 152 can project or protrude from the interior surface 13 while closing the open face 206, such as with a cap-style or button-style cover.

The post 252 is disposed in a middle section of the slot 254 such that at least initial movement of the cover 152 toward the extended position does not result in the post 252 contacting the end of the slot 254 such that the retainer 250 does not cause movement of the cartridge receptacle 150 during the initial movement. The fluid outlet port 164 of the cartridge 160 is fluidly coupled with the fluid connection port 232, which fluidly couples the fluid outlet port 164 and the treating chemistry reservoir 162 with the dispenser outlet 230. The spring 260 is in a compressed state.

Referring to FIG. 6, the dispenser assembly 48 is shown in the intermediate position with the cover 152 in the partially extended position. In the partially extended position, the cover 152 is in a pivot position (e.g., a rotational position) between the retracted position and the extended position and the post 252 is closer to, but not in contact with, the end of the slot 254. The spring 260 is less compressed than with the dispensing position. In the intermediate position, the cartridge receptacle 150 can be disposed in the same position as in the dispensing position of the dispenser assembly 48. For example, the rear and front walls 170, 172 can be parallel with the rear wall 202 and not parallel with the cover 152. With such a configuration, the cartridge 160 may not be insertable into and/or removable from the cartridge receptacle 150. Alternatively, the cartridge receptacle 150 can be pivoted outward at least to some degree, such as via the spring 260, and to a lesser extent than the cover 152. For example, the rear and front walls 170, 172 may not be parallel with the rear wall 202 or the cover 152. With such a configuration, the cartridge 160 may or may not be insertable into and/or removable from the cartridge receptacle 150, depending on the amount of pivoting of the cartridge receptacle 150.

Referring to FIG. 7, the dispenser assembly 48 is shown in the access position with the cover 152 in the extended position. In the extended position, the cover 152 is in a pivot position beyond the partially extended position and spaced from the open face 206, and the post 252 is in contact with the end of the slot 254. The cartridge receptacle 150 is pivoted beyond its position in the intermediate position of the dispenser assembly 48 but is still pivoted to a lesser extent than the cover 152 such that at least portions of the cartridge receptacle 150 are spaced from the cover 152. The cartridge receptacle 150 is disposed such that the cartridge seat 178 is accessible for inserting and removing the cartridge 160, which can include being disposed at least partially outside of the dispenser recess 200. The rear and front walls 170, 172 are not parallel with the rear wall 202 or the cover 152, and the cover 152 is not parallel with the rear wall 202. The spring 260 is compressed, at least to some degree, relative to its state in the intermediate position of the dispenser assembly 48. In the illustrated example, the fluid connection port 232 no longer extends into the cartridge receptacle 150. In other examples, the fluid connection port 232 can extend at least partially into the cartridge receptacle 150 with the dispenser assembly 48 in the access position. Additionally or alternatively, the fluid connection port 232 can move with the cartridge receptacle 150.

Figure 8:
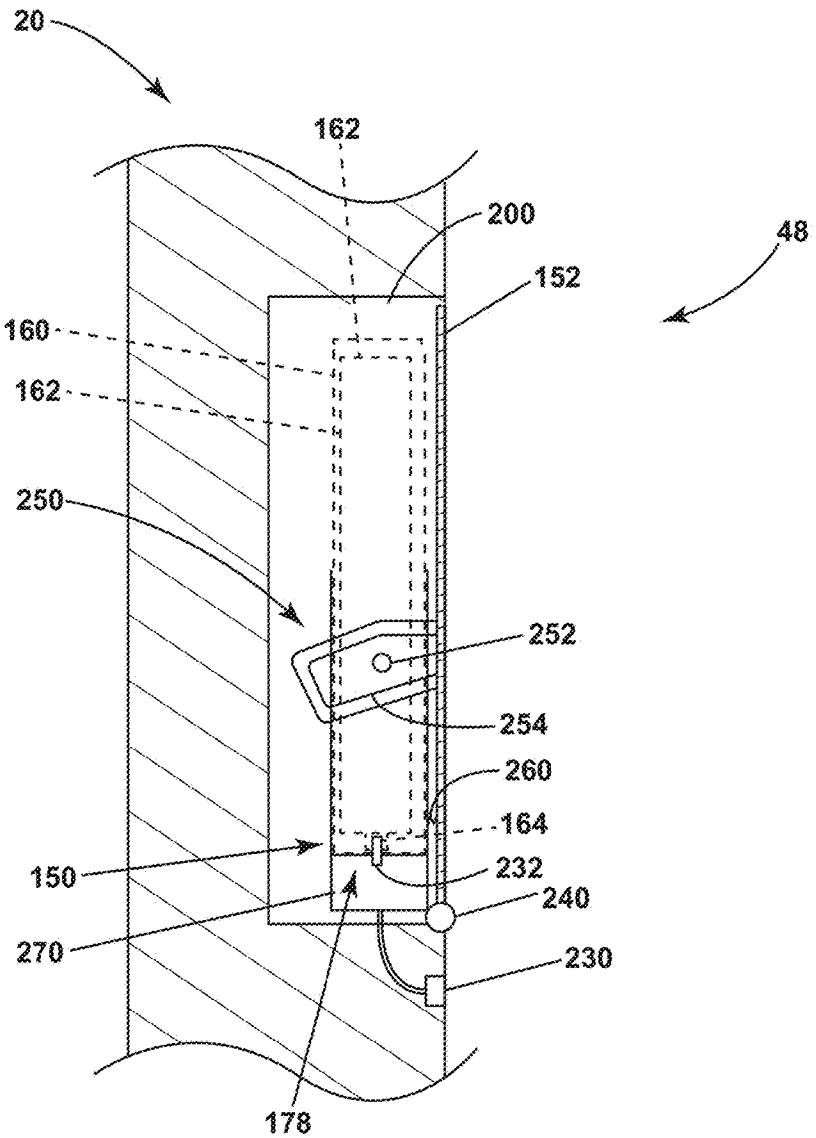
FIG. 8 is a cross-sectional perspective view of yet another dispenser assembly in the household appliance of FIG. 1 in accordance with various aspects described herein.

Referring to FIG. 8, in some configurations, the cartridge receptacle 150 can include an actuator 270, such as motor and/or a pump. The actuator 270 can be disposed below the base wall 176 and can be fluidly coupled with the fluid outlet port 164 and/or the fluid connection port 232. For example, the actuator 270 can be configured to move (e.g., pump) treating chemistry from the treating chemistry reservoir 162 through the fluid outlet port 164, through the fluid connection port 232, to the dispenser outlet 230, and/or to the treating chamber 16 (FIG. 1). The actuator 270 can move with cartridge receptacle 150. In other configurations, the actuator 270 can be disposed in a different location in the dishwasher 10, such as in the base 12 or in the door assembly 20 separate from the dispenser recess 200. In such configurations, the cartridge receptacle 150 can move relative to the actuator 270. The actuator 270 can be communicatively coupled with the controller 22 (FIG. 3) such that the controller 22 can control, at least in part, operation of the actuator 270.

Figure 9:
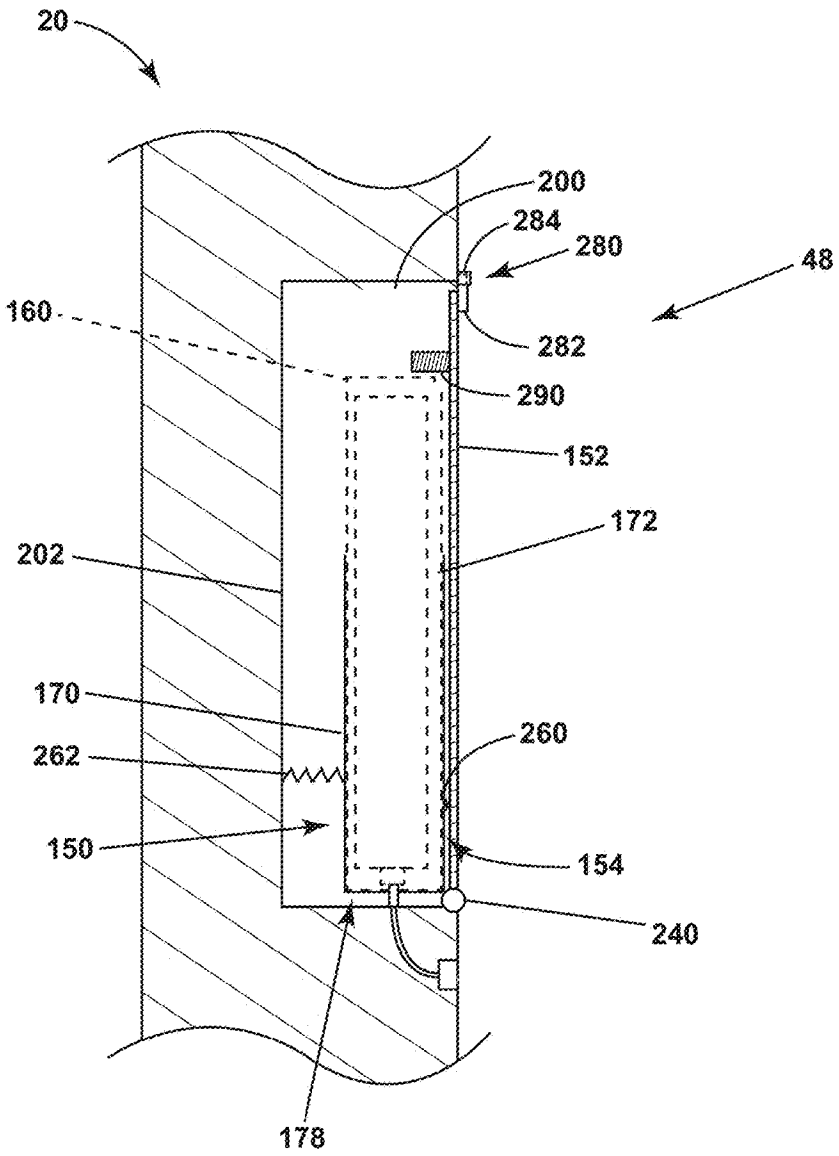
FIG. 9 is a cross-sectional perspective view of another dispenser assembly in the household appliance of FIG. 1 in accordance with various aspects described herein.
Figure 10:
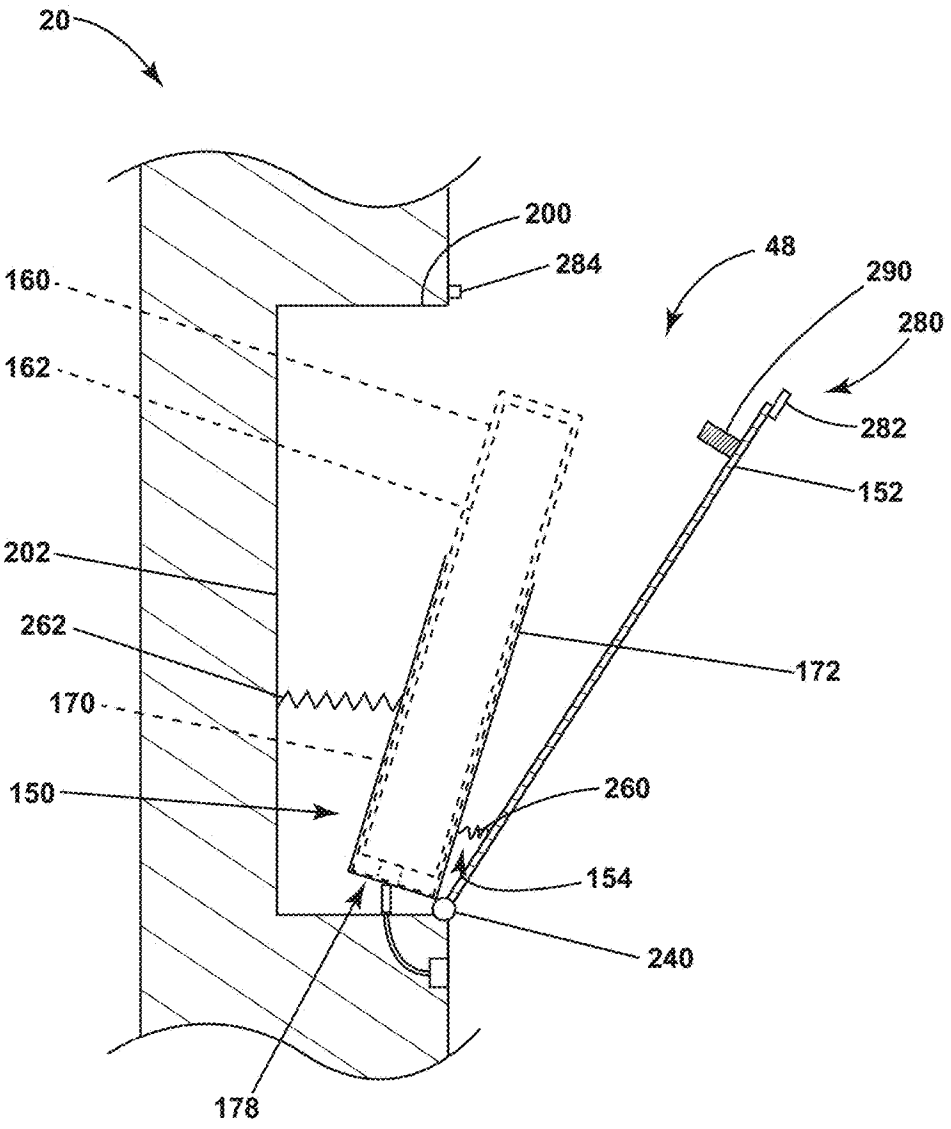
FIG. 10 is a cross-sectional perspective view of the dispenser assembly of FIG. 9 in an access position in accordance with various aspects described herein.

Referring to FIGS. 9 and 10, the linkage 154 can include the spring 260 and may not include the retainer 250 and the post 252. For example, the spring 260 can be configured to allow for relative movement of the cartridge receptacle 150 and the cover 152 and to cause the cartridge receptacle 150 to pivot outward to permit access to the cartridge receptacle 150 at least when the cover 152 is in the extended position.

The dispenser assembly 48 can include a second spring 262 and a latch assembly 280. The spring 262 is connected to the dispenser recess 200 and the cartridge receptacle 150 or the cover 152. The second spring 262 biases the cartridge receptacle 150 outward. The second spring 262 can, for example, include a coil spring. The second spring 262 may, in at least some instances, act against/opposite the spring 260. The springs 260, 262 can have different properties, such as length and/or spring constant. For example, the spring 260 can be shorter and/or have a greater spring constant than the second spring 262. The latch assembly 280 can include a first latch portion 282 that can be coupled to the cover 152 and can include a second latch portion 284 that can be coupled to the interior surface 13, such as to the inner door surface 21. The first latch portion 282 can selectively latch with the second latch portion 284 to at least temporarily latch the cover 152 in the retracted position. The second spring 262, the latch assembly 280, or both, can be included with other examples, such as with the example illustrated in FIGS. 5-7.

Referring generally to FIGS. 1-10, during operation, the cartridge 160 can be inserted into or removed from the cartridge receptacle 150 when the dispenser assembly 48 is in the access position, and the cartridge 160 can dispense treating chemistry when the dispenser assembly 48 in the dispensing position.

The cartridge receptacle 150 and the cover 152 are disposed at a first cartridge receptacle pivot position and a first cover pivot position when the dispenser assembly is in the dispensing position. The cartridge receptacle 150 and the cover 152 are disposed at a second cartridge receptacle pivot position and a second cover pivot position when the dispenser assembly is in the access position. The cover 152 pivots to a greater extent than the cartridge receptacle 150 between the dispensing and access positions such that a difference between the first and second cover pivot positions is greater than a difference between the first and second receptacle pivot positions.

In some implementations, the fluid outlet port 164 of the cartridge 160 can be coupled to or engage with the fluid connection port 232 whenever the cartridge 160 is in the seated position, regardless of the positioning of the cartridge receptacle 150. In other implementations, the fluid outlet port 164 can be coupled to the fluid connection port 232 once the dispenser assembly 48 is in the dispensing position. Regardless of where the fluid coupling is made, the fluid connection port 232 can provide a fluidic connection between the treating chemistry reservoir 162 and the dispenser outlet 230, such that treating chemistry may be dispensed/supplied to the treating chamber 16 (FIG. 1) from the cartridge 160.

For instance, in one non-limiting example of operation, a valve can be provided with the dispenser assembly 48 for selectively coupling the fluid connection port 232 to the dispenser outlet 230. In such a case, the valve can be closed when the dispenser assembly 48 is in the access position or the intermediate position, and open when the dispenser assembly 48 is in the dispensing position. In this manner, when the cartridge 160 is in the seated position and the cover 152 is in the extended or partially extended position, the fluid outlet port 164 can couple to the fluid connection port 232 and the valve can remain closed. When the cover 152 is moved into the retracted position and the dispenser assembly 48 is in the dispensing position, the valve can be opened.

In some configurations, the fluid outlet port 164 can be configured to fluidly couple to the fluid connection port 232 when at least one of (i) the cartridge 160 is in the seated position in the cartridge receptacle 150, or (ii) the dispenser assembly 48 is in the dispensing position.

In some implementations, such as generally illustrated in FIGS. 9 and 10, the cover 152 can include an inner protrusion 290. In the dispensing position (FIG. 9), the inner protrusion 290 can be disposed proximate the cartridge 160, such as to retain, latch, seal, or offset the cartridge 160. In the access position (FIG. 10), the inner protrusion 290 can be spaced from the cartridge 160 such that the inner protrusion 290 does not restrict movement of the cartridge 160 into or out of the cartridge receptacle 150, such as because of the greater movement (e.g., rotation) of the cover 152 relative to the cartridge receptacle 150. With some configurations, the cover 152 can include a plurality of inner protrusions 290.

Aspects of the disclosure provide for several benefits, including that the cartridge receptacle and the cover can move independently from each other, which can facilitate insertion/removal of the cartridge (e.g., more space between the cartridge receptacle and the cover may improve access). Additionally or alternatively, the movable coupling of the cartridge receptacle with the cover may be configured to absorb additional misuse forces during insertion and removal of the cartridge compared with other designs, such as designs where the cartridge seat is rigidly fixed with the cover. Additionally or alternatively, the independence of the cartridge receptacle and the cover can allow for or facilitate forming the cartridge receptacle and the cover from different materials. Additionally or alternatively, the independence of the cartridge receptacle and the cover can allow for the cover to include one or more inner protrusions that are disposed proximate or engaged with the cartridge in the dispensing position and that are offset from the cartridge in the access position such that the one or more inner protrusions do not restrict insertion or removal of the cartridge from the cartridge receptacle.

Further non-limiting aspects are provided by the subject matter of the following clauses:

A household appliance for treating articles according to an automatic cycle of operation, the household appliance comprising: a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface, the dispenser assembly comprising: a cartridge receptacle defining a cartridge seat; a cover; and a linkage coupling the cartridge receptacle and the cover such that the cartridge receptacle and the cover are movable relative to each other.

The household appliance of any preceding clause, wherein the interior surface defines a dispenser recess having an open face and a rear wall opposite the open face, the dispenser assembly defines a dispensing position with the cartridge receptacle being disposed in the dispenser recess and the cover closing the open face, and the dispenser assembly defines an access position with the cartridge receptacle being disposed at least partially outside of the dispenser recess and the cover spaced from the open face.

The household appliance any preceding clause, wherein, in the access position, the cartridge receptacle is spaced from the cover.

The household appliance of any preceding clause, wherein, in the dispensing position, the cartridge receptacle is disposed at a first receptacle pivot position and the cover is disposed at a first cover pivot position; in the access position, the cartridge receptacle is disposed at a second receptacle pivot position and the cover is disposed at a second cover pivot position; and a difference between the first and second cover pivot positions is greater than a difference between the first and second receptacle pivot positions.

The household appliance of any preceding clause, further comprising a pivot coupling pivotably coupling the cartridge receptacle and the cover to the inner door surface.

The household appliance of any preceding clause, wherein the interior surface defines a dispenser recess having an open face and a rear wall opposite the open face, the dispenser recess comprises a lower front edge, and the pivot coupling is disposed at the lower front edge.

The household appliance of any preceding clause, wherein the pivot coupling defines at least one pivot axis about which the cartridge receptacle and the cover are relatively pivotable.

The household appliance of any preceding clause, wherein the at least one pivot axis includes a first pivot axis about which the cover is pivotable and a second pivot axis about which the cartridge receptacle is pivotable, and the first and second pivot axes are different from each other.

The household appliance of any preceding clause, wherein the interior surface defines a dispenser recess having an open face and a rear wall opposite the open face, the dispenser recess includes a rear wall and a peripheral wall extending from the rear wall, and the door assembly includes a fluid connection port disposed on the peripheral wall.

The household appliance of any preceding clause, wherein the cartridge seat comprises a fluid connection port.

The household appliance of any preceding clause, wherein the linkage comprises a spring.

The household appliance of any preceding clause, wherein the spring biases the cover away from the cartridge receptacle.

The household appliance of any preceding clause, wherein the spring comprises at least one of a coil spring, a leaf spring, or a blade spring.

The household appliance of any preceding clause, wherein the dispenser assembly includes a second spring that biases the cartridge receptacle outward.

The household appliance of any preceding clause, wherein the dispenser assembly includes at least one of a pump or a motor.

The household appliance of any preceding clause, wherein the at least one of the pump or the motor is disposed at least partially in the cartridge receptacle such that the at least one of the pump or the motor moves with the cartridge receptacle.

The household appliance of any preceding clause, wherein the at least one of the pump or the motor is disposed at least partially in the door assembly such that the cartridge receptacle is movable relative to the at least one of the pump or the motor.

The household appliance of any preceding clause, wherein the cartridge receptacle includes a first receptacle wall and a second receptacle wall spaced from the first receptacle wall that at least partially define the cartridge seat.

The household appliance of any preceding clause, wherein the dispenser assembly defines a dispensing position with the first and second receptacle walls parallel with the cover, and an access position with the first and second receptacle walls not parallel with the cover.

The household appliance of any preceding clause, wherein the first receptacle wall and the second receptacle wall are shorter than the cover.

The household appliance of any preceding clause, wherein heights of the first and second receptacle walls are 50% or less than a height of the cover.

The household appliance of any preceding clause, wherein the linkage includes a slot defined by a retainer provided by one of the cartridge receptacle or the cover, and includes a pin provided by the other of the cartridge receptacle or the cover; and the pin is disposed at least partially in the slot.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A household appliance for treating articles according to an automatic cycle of operation, the household appliance comprising:

a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface, the dispenser assembly comprising:

a cartridge receptacle defining a cartridge seat;

a cover; and a linkage coupling the cartridge receptacle and the cover such that the cartridge receptacle and the cover are movable relative to each other;

wherein the cartridge receptacle is movable relative to the inner door surface.

2. The household appliance of claim 1, wherein the interior surface defines a dispenser recess having an open face and a rear wall opposite the open face, the dispenser assembly defines a dispensing position with the cartridge receptacle being disposed in the dispenser recess and the cover closing the open face, and the dispenser assembly defines an access position with the cartridge receptacle being disposed at least partially outside of the dispenser recess and the cover spaced from the open face.

3. The household appliance of claim 2, wherein, in the access position, the cartridge receptacle is spaced from the cover.

4. The household appliance of claim 3, wherein, in the dispensing position, the cartridge receptacle is disposed at a first receptacle pivot position and the cover is disposed at a first cover pivot position; in the access position, the cartridge receptacle is disposed at a second receptacle pivot position and the cover is disposed at a second cover pivot position; and a difference between the first and second cover pivot positions is greater than a difference between the first and second receptacle pivot positions.

5. The household appliance of claim 1, wherein the interior surface defines a dispenser recess having an open face and a rear wall opposite the open face, the dispenser recess includes a peripheral wall extending from the rear wall, and the door assembly includes a fluid connection port disposed on the peripheral wall.

6. The household appliance of claim 1, wherein the cartridge seat comprises a fluid connection port.

7. The household appliance of claim 1, wherein the linkage comprises a spring that biases the cover away from the cartridge receptacle.

8. The household appliance of claim 1, wherein the dispenser assembly includes at least one of a pump or a motor.

9. The household appliance of claim 8, wherein the at least one of the pump or the motor is disposed at least partially in the cartridge receptacle such that the at least one of the pump or the motor moves with the cartridge receptacle.

10. The household appliance of claim 8, wherein the at least one of the pump or the motor is disposed at least partially in the door assembly such that the cartridge receptacle is movable relative to the at least one of the pump or the motor.

11. The household appliance of claim 1, wherein the cartridge receptacle includes a first receptacle wall and a second receptacle wall spaced from the first receptacle wall that at least partially define the cartridge seat.

12. The household appliance of claim 11, wherein the dispenser assembly defines a dispensing position with the first and second receptacle walls parallel with the cover, and an access position with the first and second receptacle walls not parallel with the cover.

13. The household appliance of claim 11, wherein the first receptacle wall and the second receptacle wall are shorter than the cover.

14. The household appliance of claim 13, wherein heights of the first and second receptacle walls are 50% or less than a height of the cover.

15. The household appliance of claim 1, wherein the linkage includes a slot defined by a retainer provided by one of the cartridge receptacle or the cover, and includes a pin provided by the other of the cartridge receptacle or the cover; and the pin is disposed at least partially in the slot.

16. A household appliance for treating articles according to an automatic cycle of operation, the household appliance comprising:

a chassis having an interior surface at least partially defining a treating chamber for receiving the articles for treatment according to the automatic cycle of operation, the chassis including a door assembly having an inner door surface forming part of the interior surface of the chassis;

a dispenser assembly operably coupled to the interior surface, the dispenser assembly comprising:

a cartridge receptacle defining a cartridge seat;

a cover; and a linkage coupling the cartridge receptacle and the cover such that the cartridge receptacle and the cover are movable relative to each other; and a pivot coupling pivotably coupling the cartridge receptacle and the cover to the inner door surface.

17. The household appliance of claim 16, wherein the interior surface defines a dispenser recess having an open face and a rear wall opposite the open face, the dispenser recess comprises a lower front edge, and the pivot coupling is disposed at the lower front edge.

18. The household appliance of claim 17, wherein the pivot coupling defines at least one pivot axis about which the cartridge receptacle and the cover are relatively pivotable.

19. A household appliance for treating articles according to an automatic cycle of operation, the household appliance comprising:

a chassis having an interior surface at least partially defining a treating chamber for receiving the articles for treatment according to the automatic cycle of operation, the chassis including a door assembly having an inner door surface forming part of the interior surface of the chassis;

a dispenser assembly operably coupled to the interior surface, the dispenser assembly comprising:

a cartridge receptacle defining a cartridge seat;

a cover; and a linkage coupling the cartridge receptacle and the cover such that the cartridge receptacle and the cover are movable relative to each other; and wherein the linkage comprises a spring and the spring biases the cover away from the cartridge receptacle.

20. The household appliance of claim 19, wherein the dispenser assembly includes a second spring that biases the cartridge receptacle outward.

* * * * *